United States Patent [19]

Schwarzkopf

[11] Patent Number: 4,593,182

[45] Date of Patent: Jun. 3, 1986

[54] ELECTRIC CARTRIDGE HEATER

[75] Inventor: Eugen Schwarzkopf, Lüdenscheid, Fed. Rep. of Germany

[73] Assignee: Hotset Heizpatronen und Zubehor GmbH, Ludenscheid, Fed. Rep. of Germany

[21] Appl. No.: 672,586

[22] Filed: Nov. 16, 1984

[30] Foreign Application Priority Data

Dec. 3, 1983 [DE] Fed. Rep. of Germany ..... 3343824

[51] Int. Cl.[4] ..... H05B 3/44

[52] U.S. Cl. ..... 219/544; 219/523; 219/540; 219/552; 219/531; 219/541; 425/549; 338/241; 338/242; 29/615

[58] Field of Search ..... 219/336, 523, 530, 531, 219/540, 541, 544; 338/229, 238, 239, 240, 241, 242, 274; 165/104.33; 425/549, 568; 29/615

[56] References Cited

U.S. PATENT DOCUMENTS

| | | | |
|---|---|---|---|
| 2,009,980 | 7/1935 | Abbott | 338/241 |
| 3,678,249 | 7/1972 | Lennox | 219/544 |
| 4,279,588 | 7/1981 | Gellert | 425/568 |
| 4,300,038 | 11/1981 | Schwarzkopf | 219/544 |
| 4,304,544 | 12/1981 | Crandell | 425/549 |
| 4,349,727 | 9/1982 | Churchill | 219/544 |
| 4,419,567 | 12/1983 | Murphy et al. | 338/241 X |

*Primary Examiner*—Volodymyr Y. Mayewsky
*Attorney, Agent, or Firm*—Karl F. Ross; Herbert Dubno

[57] ABSTRACT

A cartridge heater includes an inner casing in which a heating element is accommodated. This inner casing is surrounded by an coaxially arranged outer casing of larger diameter so that an annular space is defined between the inner and outer casings. In the space a helical coolant piping is arranged, embedded in a highly heat-conductive substance of granular and/or pulverulent form so as to allow excess heat to be carried away.

13 Claims, 4 Drawing Figures

ELECTRIC CARTRIDGE HEATER

CROSS REFERENCE TO RELATED APPLICATION

This application is related to the commonly owned copending application Ser. No. 627,802 filed July 5, 1984.

FIELD OF THE INVENTION

My present invention relates to an electric cartridge heater.

BACKGROUND OF THE INVENTION

From German utility model DE-GM No. 74 00 309 there is known an electric cartridge heater in which a casing accommodates a carrier block of insulating material which supports a heating conductor helically wound around the carrier block. Such a cartridge heater is tightly inserted into a bore of a device to be heated so that the heat generated by the cartridge heater is transmitted to the device almost without any loss.

The cartridge heater according to the prior art has, however, the disadvantage that there is no provision to permit excess heat to be carried away.

It is, however, known to equip such cartridge heaters with thermostats which turn off the heater once the device has reached the desired temperature. In case the temperature of the device is below the desired value, the thermostat activates the cartridge heater so that the desired temperature can be kept approximately at a constant value.

Although this principle may seem to be sound, there is the drawback that in case additional heating sources are present, e.g. generating frictional heat, a temporary overheating may be obtained when the device is already at its desired temperature. Such overheating cannot be corrected by the thermostat since it acts only when the temperature of the device is below a desired value. Thus a temporary overheating of the device and of the cartridge heater cannot be prevented.

OBJECTS OF THE INVENTION

It is the principal object of my invention to provide an improved electric cartridge heater obviating the aforestated drawbacks.

Another object of the invention is to provide an improved cartridge heater capable of more precise temperature control.

SUMMARY OF THE INVENTION

I realize these objects, according to the invention, by providing an outer casing around an inner casing accommodating a heating element and to arrange in the space defined between the inner and the outer casing a coolant piping which is capable of carrying away any generated excess heat. The coolant piping is embedded in a highly heat-conductive substance which may be provided in a granular and/or pulverulent form so that the space is completely filled with the coolant piping and the substance.

Through the provision of such a cartridge heater, overheating is altogether prevented as the cartridge heater can selectively be used as heater or cooler. Moreover, the cartridge heater according to the invention is simple and has a compact shape and provides a quick and uniform transmittal of heat generated by the heating unit or a cooling effect—provided by a fluid flowing through the coolant piping—of the entire surface of the cartridge heater.

It is especially advantageous to provide the coolant piping with at least one surface contacting at least one and preferably both of the casings to enhance the heating and cooling effect. The outer casing as well as the substance in which the coolant piping is embedded is of metal, preferably of copper. For obtaining a selective cooling of certain zones, it is proposed to provide the coolant piping with zones of different pitch so as to be able tPVo intensify the cooling along certain areas.

When producing the cartridge heater, an elongated pipe is bent at its center into a U-shaped and then wound around the inner casing so as to have the form of a double helix. The respective ends of the shanks obtained through the bending step extend through the outer casing or through the ring sealing the space at the respective end face.

After the coolant piping is thus wound around the inner casing, it is inserted within the outer casing whose diameter is then reduced to provide the piping of originally circular cross-section with a polygonal profile.

Preferably the electric heater is of a type in which an electric (resistive) heating coil is surrounded by a mass of insulating particles, e.g. quartz particles, which completely fill the inner cylindrical casing which, after filling, is compressed and plastically deformed (reduced in diameter) to compact the mass around the coil and in the interstices thereof. The outer casing, which like the inner casing can be composed of copper and is coaxial therewith, can receive the cooling-tube coil which can be wrapped snugly around the inner casing and which can contact the outer casing. All interstices within the annular compartment between the casings are then filled with the pulverulent mass of conductive material, e.g. copper particles, and the outer casing is then compressed and plastically deformed (reduced in diameter) to compact this latter mass and further compact the mass of insulating particles. Additionally, the copper coolant tube can be radially compressed by the latter compaction or reduction step so that it is flattened against both casings and assumes a substantially rectangular cross section with broad surfaces in contact with both casings.

BRIEF DESCRIPTION OF THE DRAWING

The above and other features of my present invention will now be described in detail with reference to the accompanying drawing in which.

SPECIFIC DESCRIPTION

Figure 1:
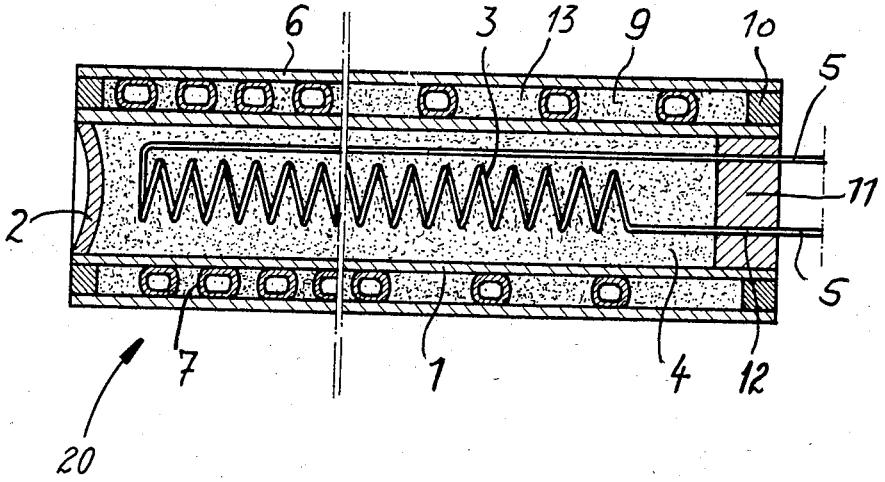
FIG. 1 is a longitudinal cross-section through an electric cartridge heater according to the invention.

FIG. 1 shows an electric cartridge heater generally characterized by numeral 20 and including an elongated cylindrical casing 1 of copper which accommodates in an electrically insulated manner a helical electric heating conductor or resistive-heating coil 3. The heating conductor 3 is embedded within an insulating material 4 which once the casing 1 is reduced in its diameter becomes compressed so as to completely fill the interior of the casing 1 together with the heating conductor 3. One end portion of the casing 1 is closed by a curved end wall 2 of copper while the opposing end portion is sealed by a conventional plug 11 which is provided with two through-passages 12 arranged parallel to each other. The reduction step can deform the end wall 2 inwardly. Through the through-passages 12, the conductor 3 projects with its connecting ends 5 parallel to the axis beyond the plug 11.

Figure 2:
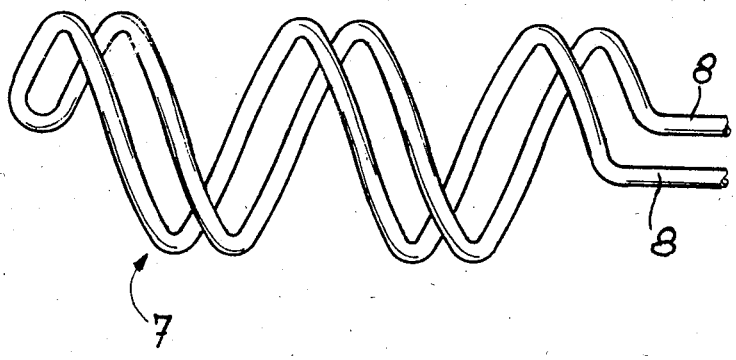
FIG. 2 illustrates a cooling element arranged in the cartridge heater.

Coaxially surrounding the casing 1 is a further cylindrical casing 6 of a highly heat-conductive metal, especially copper. As the inner casing 1 has a diameter smaller than the diameter of the outer casing 6, an annular space 13 is defined therebetween which accommodates a coolant piping 7 essentially extending along the entire length of the heating conductor 3. I may note, however, that it is certainly possible to provide the coolant piping 7 only along a portion of the heating conductor 3. As can be seen especially from FIG. 2, the coolant piping 7 is shaped in the manner of a double-helix and has two end connections 8 projecting to the outside so as to be connectable to a coolant source and to a thermostat arrangement which energizes the heating coil when the temperature drops and a circulating coolant through the tube when the temperature rises excessively.

Figure 3:
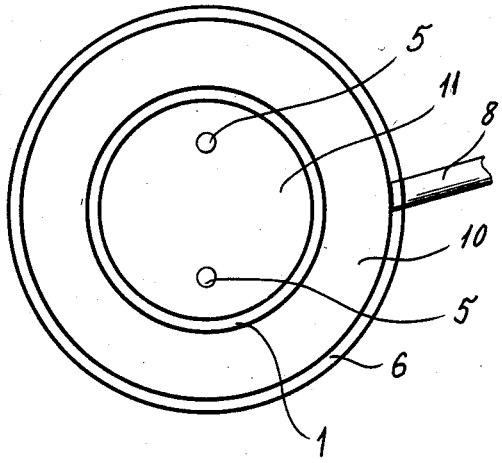
FIG. 3 is an end view of the cartridge heater of FIG. 1.
Figure 4:
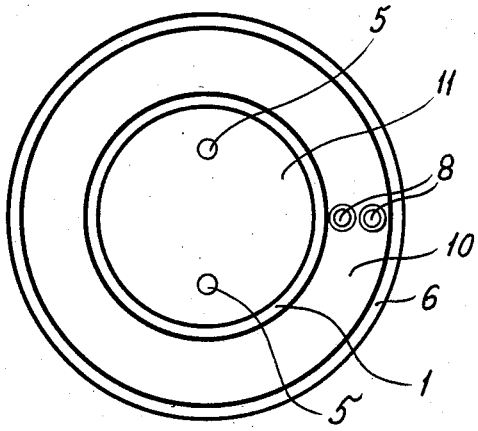
FIG. 4 is an end view of a cartridge heater according to another embodiment.

At each of its opposing end faces, the annular space 13 is sealed off by a respective ring 10 which is inserted in a tight fit manner and is made of a metal, especially of copper. In order to allow the end connections 8 of the coolant piping 7 to project towards the outside, one ring 10 (in FIG. 1, the ring 10 at the right-hand side) is provided with two through openings 14 through which the respective end connections 8 project in an axis parallel manner (FIG. 4). It is, however, also feasible to provide through-openings 15 in the outer casing 6 in order to allow the connections 8 to project radially towards the outside (FIG. 3).

In addition, the annular space 13 is provided with a highly heat-conductive granular and/or pulverulent substance 9, e.g. copper granules, so that the annular space 13 is completely filled by the coolant piping 7 and the substance 9, once the outer casing 6 is reduced in its diameter and the substance 9 is compressed.

During this reduction of the diameter of the outer jacket 6, the insulating material 4 can be compressed again as well.

In order to provide the coolant piping 7 in the shape of a double helix, an elongated pipe of preferably circular cross-section is firstly bent at its center to a U-shape so that its both shanks extend axis parallel. Then the shanks are simultaneously helically wound with the same winding diameter. After forming the end connections 8 by bending the end portions of the pipe accordingly, the coolant piping 7 is provided with sections of different pitch so that the heating conductor can selectively be cooled, i.e. that sections with a smaller pitch can provide a high cooling effect than those sections with a larger pitch.

Once the coolant piping 7 is provided in the double helix shape and is arranged within the annular space 13, the outer casing 6 is compressed or reduced in its diameter so that the original circular cross-section of the piping 7 is changed to a polygonal profile, especially a rectangular profile as shown in FIG. 1. Thus, the coolant piping 7 is sandwiched between the casings 1 and 6 such that the longer profile sides extending in elongation of the casings 1 and 6 are in surface contact therewith.

I claim:

1. An electric cartridge heater comprising:

an inner casing of heat conductive material having a longitudinal axis;

an elastic heating coil within said inner casing extending along said axis;

a compacted body of granular heat conductive but electrically insulating material surrounding said coil and filling said inner casing;

an outer casing of heat conductive material surrounding said inner casing and defining an annular space therewith;

a cooling-tube coil in said space surrounding said inner casing for carrying away excess heat and in contact with at least one of said casings and in thermally conductive relationship with both casings; and a compacted mass of thermally conductive granules filling said space between the turns of said cooling-tube coil.

2. A cartridge heater as defined in claim 2 wherein said conductive granules are at least predominantly copper.

3. A cartridge heater as defined in claim 2 wherein said cooling tube coil has surfaces in contact with both said casings.

4. A cartridge heater as defined in claim 3 wherein said cooling tube coil has a polygonal cross-section.

5. A cartridge heater as defined in claim 4 wherein said cooling-tube coil has a rectangular cross-section so as to define two opposing sides of longer dimensions which extend in direction of said axis, said sides constituting said surfaces.

6. A cartridge heater as defined in claim 1 wherein said outer casing is of a highly heat-conductive metal.

7. A cartridge heater as defined in claim 6 wherein said outer casing is of copper.

8. A cartridge heater as defined in claim 2, further comprising at least two rings, said space having opposing end faces, each of which being sealed off in a tight manner by a respective one of said rings.

9. A cartridge heater as defined in claim 8 wherein each of said rings is of copper.

10. A cartridge heater as defined in claim 2 wherein said cooling-tube coil is sectioned in zones of different pitches.

11. A cartridge heater as defined in claim 2 wherein said cooling-tube coil extends parallel to said axis along a portion of said heating coil.

12. A cartridge heater as defined in claim 2 wherein said cooling-tube coil is arranged around said inner casing in a shape of a double helix and has two end connections extending through said outer casing to project radially toward the outside.

13. A cartridge heater as defined in claim 2 wherein said cooling-tube coil is arranged around said inner casing in the shape of a double helix and has two end connections extending axis parallel through one of said rings to project toward the outside.

* * * * *